US011060350B2

(12) United States Patent
Randall

(10) Patent No.: US 11,060,350 B2
(45) Date of Patent: Jul. 13, 2021

(54) PROTECTIVE FRAME ASSEMBLY

(71) Applicant: Mr. Screen, Richardson, TX (US)

(72) Inventor: James Lawrence Randall, Richardson, TX (US)

(73) Assignee: MR. SCREEN, LLC., Richardson, TX (US)

( * ) Notice: Subject to any disclaimer, the term of this patent is extended or adjusted under 35 U.S.C. 154(b) by 0 days.

(21) Appl. No.: 15/787,579

(22) Filed: Oct. 18, 2017

(65) Prior Publication Data

US 2019/0112873 A1 Apr. 18, 2019

(51) Int. Cl.
*E06B 9/52* (2006.01)

(52) U.S. Cl.
CPC ..... *E06B 9/52* (2013.01)

(58) Field of Classification Search
CPC ..... E06B 9/52; E06B 2009/527
See application file for complete search history.

(56) References Cited

U.S. PATENT DOCUMENTS 1,350,027 A * 8/1920 Lane ..... E06B 9/52 160/381
1,464,370 A * 8/1923 Novick ..... E06B 9/52 160/374
1,502,693 A * 7/1924 Stickle ..... E06B 9/52 160/381
1,524,724 A * 2/1925 Wagner ..... E06B 9/52 16/249
1,588,161 A * 6/1926 Bost ..... E06B 9/52 160/371
1,594,812 A * 8/1926 Blackburn ..... E06B 9/52 160/354
1,950,730 A * 3/1934 Kegley ..... E06B 9/52 160/40
1,990,206 A * 2/1935 Rose ..... E06B 9/52 160/353
2,436,277 A * 2/1948 Willett ..... E06B 9/52 160/353
2,446,743 A * 8/1948 Davis ..... E06B 9/52 160/105
2,627,311 A * 2/1953 Kaufmann ..... E06B 9/52 160/395
2,709,489 A * 5/1955 Keebler ..... E06B 9/52 160/381
2,797,750 A * 7/1957 Van Dette ..... E06B 9/52 108/24
2,835,325 A * 5/1958 Gilbert ..... E06B 9/52 16/273

(Continued)

*Primary Examiner* — Johnnie A. Shablack
(74) *Attorney, Agent, or Firm* — Kenealy Vaidya LLP

(57) ABSTRACT

Some embodiments are directed to a protective frame assembly. The frame assembly includes a first frame including an inner wall surface and an outer wall surface opposite to the inner wall surface. The inner wall surface includes a channel. The frame assembly also includes a second frame including a front wall surface and a rear wall surface. The rear wall surface of the second frame faces the inner wall surface of the first frame. The frame assembly further includes a spline received within the channel of the first frame. The frame assembly also includes a mesh sandwiched between the inner wall surface and the rear wall surface. The spline engages with the mesh within the channel to retain the mesh in a tensioned state.

18 Claims, 6 Drawing Sheets

(56) References Cited

U.S. PATENT DOCUMENTS 2,897,889 A * 8/1959 Kessler ..... B07B 1/48 160/392
3,009,516 A * 11/1961 Albee, Jr. ..... E06B 9/52 160/381
3,058,518 A * 10/1962 Housman ..... E06B 3/285 160/380
3,142,504 A * 7/1964 Jordan, Sr. ..... E05D 15/00 292/220
3,187,801 A * 6/1965 Saling ..... E06B 3/28 160/371
3,220,469 A * 11/1965 Oehmig ..... E06B 9/52 160/380
3,321,885 A * 5/1967 Pratt ..... A47G 1/0605 160/381
3,374,597 A * 3/1968 Whitener ..... E06B 9/52 160/391
3,875,065 A * 4/1975 Rosenblum ..... B07B 1/48 209/403
4,164,105 A * 8/1979 Herbst ..... E06B 3/28 160/394
4,232,310 A * 11/1980 Wilson ..... B07B 1/4627 160/10
4,341,255 A * 7/1982 Mock ..... E06B 3/28 160/368.1
4,562,634 A * 1/1986 Watts ..... B44C 7/022 160/392
4,589,464 A * 5/1986 Coller ..... E06B 9/52 160/91
4,603,724 A * 8/1986 Borwick ..... E06B 9/52 160/180
4,662,038 A * 5/1987 Walker ..... F16B 5/0692 160/392
4,899,797 A * 2/1990 Green ..... E06B 9/52 160/380
4,932,457 A * 6/1990 Duncan ..... E06B 9/52 160/371
5,141,046 A * 8/1992 Duncan ..... E06B 9/52 160/371
5,143,138 A * 9/1992 Zwart ..... E06B 9/521 160/369
5,301,737 A * 4/1994 Martin ..... E06B 9/52 160/380
6,125,910 A * 10/2000 Pepperell ..... E06B 9/01 160/371
6,263,949 B1 * 7/2001 Guthrie, Jr. ..... E06B 3/5807 160/371
6,505,669 B2 * 1/2003 Lilie ..... E06B 9/04 160/371
6,945,305 B1 * 9/2005 Limauro ..... E06B 9/52 160/369
7,740,048 B2 * 6/2010 Wilson ..... E06B 9/52 160/179
8,056,602 B1 * 11/2011 Green ..... E06B 9/52 160/392
8,985,183 B2 * 3/2015 Terry ..... E06B 9/24 160/371
9,157,271 B2 * 10/2015 Burton ..... E06B 9/24
2004/0020157 A1 * 2/2004 Bass ..... E06B 9/52 52/656.7
2006/0231221 A1 * 10/2006 Chen ..... E06B 9/24 160/392
2008/0005987 A1 * 1/2008 Meadows ..... E06B 9/52 52/311.1
2008/0289780 A1 * 11/2008 McGregor ..... D03D 9/00 160/371
2009/0071087 A1 * 3/2009 Achen ..... E06B 7/02 52/302.1
2010/0147471 A1 * 6/2010 Bull ..... E06B 9/52 160/381
2014/0130993 A1 * 5/2014 Zwar ..... E06B 5/00 160/371

* cited by examiner

700

PROTECTIVE FRAME ASSEMBLY

BACKGROUND

The disclosed subject matter relates to protection of articles (e.g., windows, doors etc.) from striking objects, such as golf balls, baseballs, and wind-blown objects (e.g., light lawn furniture). In particular, the disclosed subject matter relates to a protective frame assembly configured to safeguard articles from striking objects.

For those living near golf courses or parks, it is common for windows, window frames, exposed surfaces, and other items to be damaged by golf balls and/or baseballs. Glass windows and doors are also susceptible to being damaged by flying objects during extreme weather events, such as hurricanes. If a glass window or a door of a building is struck with sufficient force by a flying object, the glass of the window or the door will shatter. The shards of shattered glass can themselves become potentially lethal missiles that are capable of causing damage, injury, or even death. Also, after shattering the glass, the object may continue moving and potentially cause further damage, injury, or death inside the building.

SUMMARY

Various shields and guards for protecting a glass screen of a fenestration unit are known. However, such shields are designed to be damaged to protect the glass screen they are protecting. Further, such shields are not designed to remain attached during non-severe conditions.

Some related arts describe metal sheets designed to stop an entry of persons or objects by simple brute force. However, such metal sheets block passage of light and air flow through the protected area such as, window(s), door(s) and so forth. Further, such metal sheets may also be susceptible to corrosion due to ambient elements over time.

Some related arts describe one or more hinged panels made of plastic for the purpose of protecting window(s) or door(s) from golf balls. However, such materials may get discolored (e.g., turn yellow) or opaque over time and limit the field of view. Further, such materials are also susceptible to cracks. Moreover, such panels may also prevent or impede flow of air.

It may therefore be beneficial to provide a protective frame assembly to protect a glass screen, a surface, and/or an object from striking objects or missiles such as, golf balls, baseballs, hail, wind-blown objects and so forth. Specifically, it may be beneficial to provide a frame structure to rigidly hold a mesh. Further, the frame structure is designed to withstand both the static stresses of the mesh and dynamic stresses of strike(s) without distortion, dents, or detectable damage.

It may also be beneficial to provide a protective frame assembly including a first frame and a second frame, and a mesh sandwiched between the first frame and the second frame, wherein the mesh is adapted to allow light and air to pass therethrough.

It may further be beneficial to provide a protective frame assembly coated with a bonding coating material to prevent chipping and to match a trim of a building on which the protective frame assembly is mounted. The protective frame assembly is further coated with a protective coating to prevent corrosion.

It may also be beneficial to provide a protective frame assembly with an insect barrier to exclude insects. The insect barrier may also stop striking objects.

Some embodiments are directed to a protective frame assembly. The protective frame assembly includes a first frame including an inner wall surface and an outer wall surface opposite to the inner wall surface. The inner wall surface includes a channel. The protective frame assembly also includes a second frame coupled to the first frame. The second frame includes a front wall surface and a rear wall surface opposite to the front wall surface. The rear wall surface of the second frame faces the inner wall surface of the first frame. The protective frame assembly further includes a spline received within the channel of the first frame. The protective frame assembly also includes a mesh sandwiched between the inner wall surface of the first frame and the rear wall surface of the second frame. The spline engages with the mesh within the channel to retain the mesh in a tensioned state.

Some other embodiments are directed to a protective frame assembly for an external structure. The protective frame assembly includes a first frame coupled to the external structure. The first frame includes an inner wall surface and an outer wall surface opposite to the inner wall surface. The inner wall surface includes a channel. The protective frame assembly also includes a second frame coupled to the first frame. The second frame includes a front wall surface and a rear wall surface opposite to the front wall surface. The rear wall surface of the second frame faces the inner wall surface of the first frame. The protective frame assembly further includes a spline received within the channel of the first frame. The protective frame assembly also includes a mesh sandwiched between the inner wall surface of the first frame and the rear wall surface of the second frame. The spline engages with the mesh within the channel to retain the mesh in a tensioned state.

Yet other embodiments are directed to a method of assembling a protective frame assembly. The method includes providing a first frame including an inner wall surface and an outer wall surface opposite to the inner wall surface. The inner wall surface includes a channel. The method also includes placing a mesh on the inner wall surface of the first frame. The method further includes placing a spline within the channel of the first frame so that the mesh passes between the spline and the inner wall surface of the first frame. The spline engages with the mesh within the channel to retain the mesh in a tensioned state. The method also includes coupling a second frame to the first frame so that the mesh is sandwiched between the first frame and the second frame.

BRIEF DESCRIPTION OF DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

I. Protective Frame Assembly

Figure 1A:
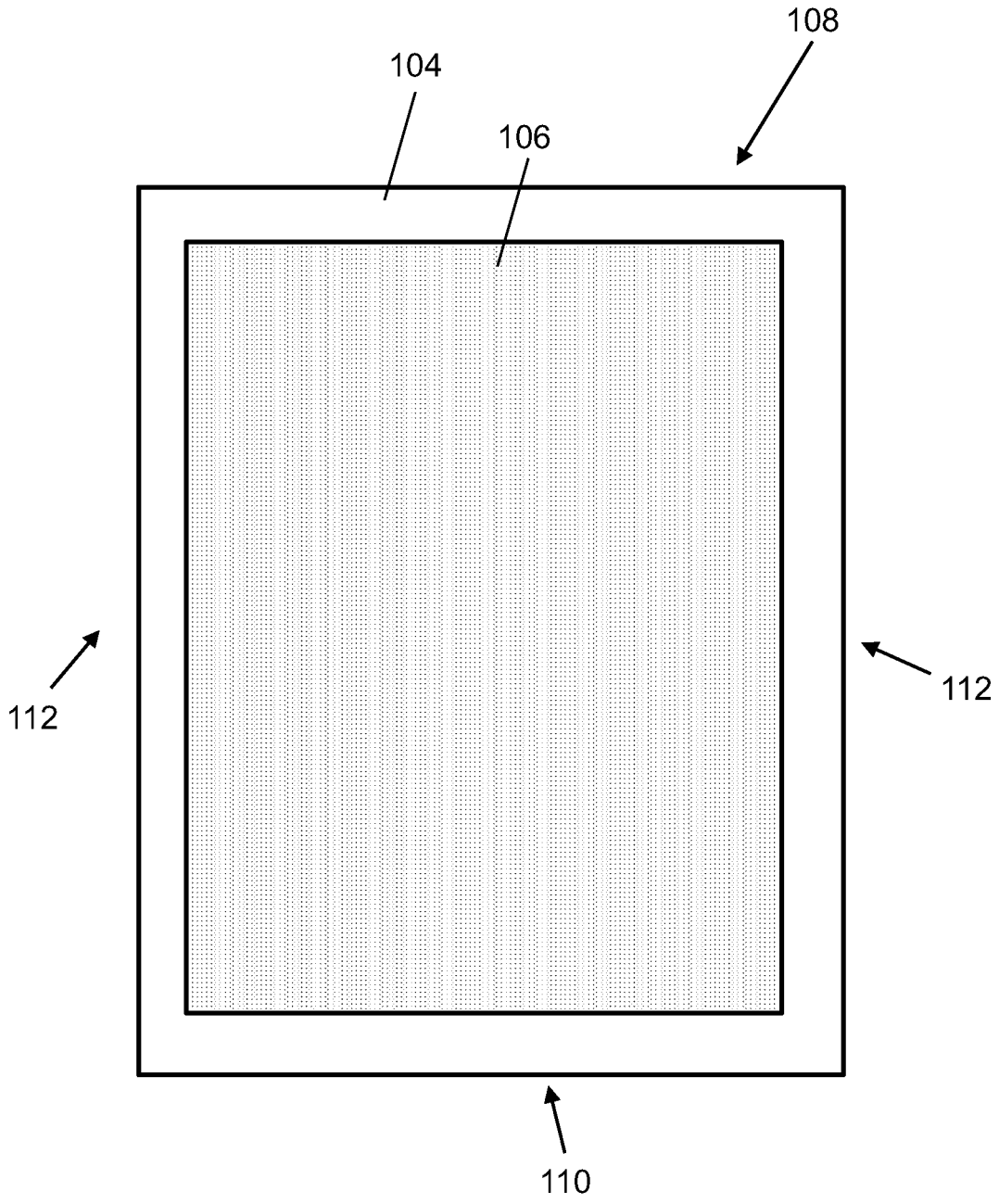
FIG. 1A illustrates a front view of a protective frame assembly in accordance with the disclosed subject matter.
Figure 1B:
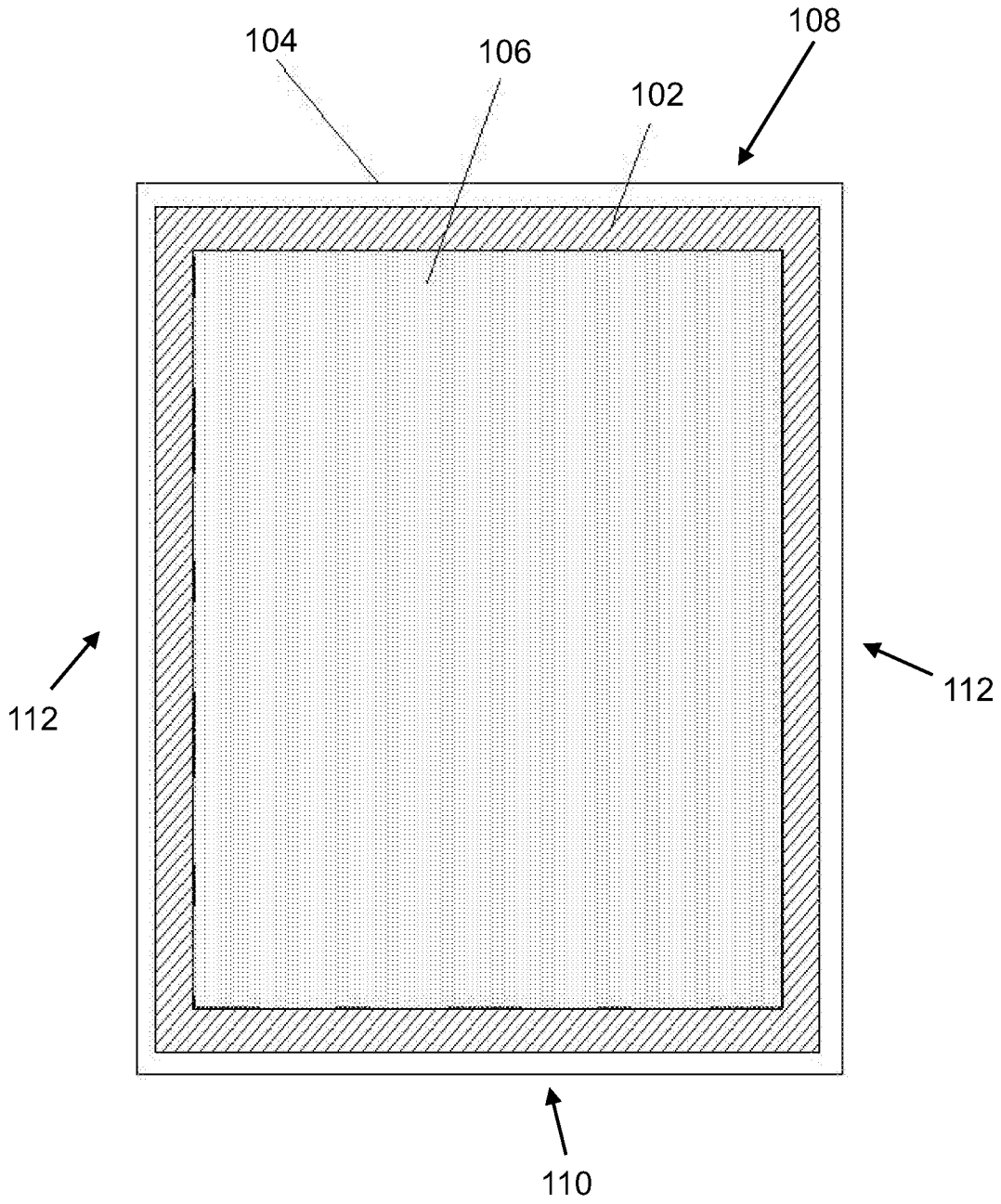
FIG. 1B illustrates a rear view of the protective frame assembly of FIG. 1A.

FIG. 1A illustrates a front view of a protective frame assembly 100 (interchangeably referred to as "the frame assembly 100"), in accordance with an embodiment of present disclosure. FIG. 1B illustrates a rear view of the protective frame assembly 100. In some embodiments, the protective frame assembly 100 can be installed to protect a glass screen of a window, a door and/or any other fenestration unit from striking objects or missiles such as, but not limited to, golf balls, baseballs, hail, and wind-blown objects (e.g., light-weight lawn furniture). In some other embodiments, the protective frame assembly 100 may be used for protecting surface(s) or object(s) from damage due to storms, vandals, burglars and so forth. In further embodiments, the protective frame assembly 100 may prevent insects from entering a building through a window or a door. The protective frame assembly 100 includes a top side 108, a bottom side 110 opposite to the top side 108 and a pair of lateral sides 112 extending between the top side 108 and the bottom side 110. The top side 108, the bottom side 110 and the pair of lateral sides 112 together defines a rectangular shape of the protective frame assembly 100.

Referring to FIGS. 1A and 1B, the protective frame assembly 100 includes a first frame 102, a second frame 104 coupled to the first frame 102 and a mesh 106. In some embodiments, the first frame 102 may be anchored to a wall, or alternatively to a window or a door frame. In some embodiments, the first frame 102 may add strength and rigidity to the protective frame assembly 100. The first frame 102 may also provide a preliminary holding point for the mesh 106. The preliminary holding point may be a preliminary point of attachment of the mesh 106 with the first frame 102 during assembly. In some embodiments, the first frame 102 may have a rectangular shape. In an embodiment, the first frame 102 may include an elongate tubular structure defining the rectangular shape of the first frame 102. In another embodiment, the first frame 102 may have a solid configuration. In some other embodiments, the first frame 102 may have any other configuration that have suitable strength, rigidity, and weight based on the application of the protective frame assembly 100.

In an exemplary embodiment, the first frame 102 may include an inner wall surface (not shown in FIGS. 1A and 1B) and an outer wall surface (not shown in FIGS. 1A and 1B) opposite to the inner wall surface. The inner wall surface includes a channel. The channel is configured to receive a spline (not shown in FIGS. 1A and 1B), which is configured to engage with the mesh 106 within the channel to retain the mesh 106 in a tensioned or stressed state. In an exemplary embodiment, the spline within the channel may prevent crawling or movement of the mesh 106. Crawling of the mesh 106 may otherwise result in reduction in tensioning of the mesh 106 over time. The spline may have any suitable shape, such as, but not limited to, circular, rectangular, elliptical and so forth. Further, the spline may be made from any suitable material that can be received within the channel, such as including but not limited to rubber or rubber-like materials, and especially those materials that are high temperature and UV exposure rated. The spline can be forcibly compressed into the channel to secure the mesh. The shape, size and material of the spline are exemplary in nature and the spline may any shape, size or material based on requirements. In an embodiment, the spline may be coupled to the first frame 102 via one or more members, such as springs.

The outer wall surface may be mounted on a fenestration unit. The fenestration unit may include any structure that covers an opening of a building. In various embodiments, the fenestration unit may include a structure such as, but not limited to, a window, a door, a louvre, vents, a skylight, a storefront, a curtain wall, a slope glazed system and so forth. The fenestration unit may allow and/or block the passage of light and flow of air through a building. In some embodiments, the outer wall surface of the first frame 102 is mounted on a wall, a window frame or a door frame. In some embodiments, the outer wall surface may be mounted on a frame of the fenestration unit by any suitable mechanical fasteners such as, but not limited to, screws, nut and bolt assemblies, nails and so forth. In some other embodiments, the outer wall surface may be coupled to an external structure. The external structure may include any structure such as, but not limited to, a frame of a fenestration unit, a wall, a supporting structure, and so forth. In another embodiment, the outer wall surface may be pivotally coupled to the external structure via one or more hingers. In a further embodiment, the one or more hinges may be integral with the outer wall surface.

In some embodiments, the first frame 102 may be fabricated of extruded aluminum of sufficient heavy duty construction to resist high impact forces caused by hurricane force winds, and/or missiles such as, but not limited to, golf balls, baseballs, hail, wind-blown objects (e.g., lightweight lawn furniture) and debris. In some other embodiments, the first frame 102 may be made up of a corrosion resistive material which can be used in any environment such as, high moisture environment, salt air environment and so forth. The first frame 102 may be coated with a bonding coating material to prevent chipping and to match a trim of a building on which the frame assembly 100 is mounted.

In an embodiment, the second frame 104 may have a L-shaped configuration. The second frame 104 includes a front wall surface (not shown in FIGS. 1A and 1B) and a rear wall surface (not shown in FIGS. 1A and 1B) opposite to the front wall surface. In an exemplary embodiment, the rear wall surface of the second frame 104 faces the inner wall surface of the first frame 102.

In some embodiments, the rear wall surface includes a tongue aligned with channel defined by the inner wall surface. The tongue may engage with the spline to retain the spline within the channel. In an exemplary embodiment, the tongue may apply a force on the spline to prevent crawling of the mesh 106 and keep the mesh 106 in a tensioned state. In some embodiments, the tongue may be integrally formed with the second frame 104. In some other embodiments, the tongue may be coupled to the rear wall surface of the second frame 104 by any suitable coupling methods, such as, but not limited to, welding, brazing, adhesives, mechanical joints, fasteners and so forth. In further embodiments, the rear wall surface may have a planar shape. The rear wall surface may abut the inner wall surface of the first frame 102 to retain the mesh therebetween. In other embodiments, the rear wall surface may include a spring aligned with the channel. The spring may engage with the spline to retain the spline within the channel.

In some embodiments, the second frame 104 may have a solid configuration. In other embodiments, the second frame 104 may be fabricated of extruded aluminum of sufficient heavy duty construction to resist high impact forces caused by hurricane force winds, and/or missiles such as, but not limited to, golf balls, baseballs, hail, wind-blown objects (e.g., lightweight lawn furniture) and debris. In further embodiments, the second frame 104 may be made up of a corrosion resistive material which can be used in any environment such as, high moisture environment, salt air environment and so forth. In some embodiments, the second frame 104 may be coated with a boding coating material to prevent chipping and to match a trim of the building on which the protective assembly 100 is mounted. In some embodiments, the first frame 102 and the second frame 104 may be coupled to each other using one or more mechanical fasteners (not shown in FIGS. 1A and 1B). In alternative embodiments, the first frame 102 and the second frame 104 may be coupled to each other by any other methods, such as adhesives, welding, brazing, mechanical joints, and so forth. In an embodiment, the tongue is manufactured from a material similar to the material of the second frame 104. In some other embodiments, the tongue may be manufactured from any other suitable material (e.g., wood).

In an exemplary embodiment, the mesh 106 is sandwiched between the rear wall surface of the second frame 104 and the inner wall surface of the first frame 102. In some embodiments, the rear wall surface and the inner wall surface may be coupled to each other via some adhesive. In other embodiments, the rear wall surface and the inner wall surface may be coupled to each other via one or more mechanical fasteners such as, nails, screws, nut and bolt assemblies and so forth. Alternatively, the rear wall surface and the inner wall surface may be coupled to each other by any other suitable means (e.g., a mechanical joint) which can retain the mesh 106 with sufficient tension.

The mesh 106 may be retained in a stressed or tensioned state by the first frame 102 and the second frame 104. In some embodiments, the spline may apply a primary gripping force on the mesh 106 to retain the mesh 106 in the tensioned state. The tongue may engage with the spline and pushes the spline towards the mesh 106. As a result, the spline presses against the mesh 106 within the channel and apply the requisite gripping force. In further embodiments, an additional or secondary gripping force may be supplied by the compression of the mesh 106 between the rear wall surface of the first frame 102 and the inner wall surface of the second frame 104. The primary gripping force applied by the spline and the tongue, and the secondary gripping force applied due to compression between the first and second frames 102, 104, may prevent crawling of the mesh 106. The mesh 106 is adapted to absorb an impact energy when a foreign object strikes the mesh 106. Further, the mesh 106 may expel the foreign object upon absorbing the impact energy.

The first frame 102, the spline, the mesh 106 and the second frame 104 including the tongue may form a frame sandwich configuration. The frame sandwich configuration (hereinafter referred to as "the sandwich configuration") includes the first frame 102 as one layer and the second frame 104 as another layer, and the mesh 106 retained between the first frame 102 and the second frame 104. The mesh 106 is engaged by the spline in the sandwich configuration. The sandwich configuration is designed to withstand both the static stresses of the mesh 106 and the dynamic stresses of strike(s) without distortion, dents, or other detectable damage on the mesh 106. The sandwich configuration sets and holds tension on the mesh 106. The sandwich configuration of the first frame 102, the second frame 104 and the mesh 106 may also allow a controlled deflection of the mesh 106 towards a plane of a glass or a protected surface. Further, the sandwich configuration may reduce a force of the striking object over a calculated distance until a stopping force exceeds the force of the strike. Due to the sandwich configuration, the mesh 106 may return to its pre-strike condition and position, expelling the striking object in the process.

In some embodiments, the mesh 106 is adapted to allow light and air to pass therethrough. The mesh 106 includes a plurality of openings to allow the passage of light and flow of air. Further, an intensity of light and/or air flow may depend upon a density of the mesh 106. Mesh density may refer to the number of elements per unit area in the mesh 106. In some embodiments, a size of each opening of the mesh 106 may depend upon a weight, a velocity, a shape and dimensions of a potential striking object such as, golf balls, baseballs and so forth.

In some embodiments, the mesh 106 is made of a composite material, or a non-metallic material. In some other embodiments, the mesh 106 includes a metallic material coated with a corrosion resistant material such as, but not limited to, a polyester film. In an embodiment, the material of the mesh 106 may be resistant to any changes in color over time. In some embodiments, the mesh 106 may be made of perforated heavy-duty galvannealed steel or stainless steel. Alternatively, the mesh 106 may be made of any material that provide sufficient strength, air flow, and light passage through the protective frame assembly 100. The mesh 106 may be coated with a protective coating (e.g., anodized) to protect the mesh 106 against mildew and rot. In some embodiments, the mesh 106 may be made of a material that can withstand dynamic stresses of strike(s) without distortion, dents, or other detectable damage. In other embodiments, the material of the mesh 106 may have sufficient strength to function effectively as a storm shield capable of withstanding strong winds of hurricane intensity, as well as debris borne by these winds. Further, the material of the mesh 106 may be resistant to any kind of decay such as, but not limited to, cracks, low visibility, blockage and so forth. In alternative embodiments, the mesh 106 may be baked with a liquid coating to enhance an aesthetic appearance of the mesh 106.

In an embodiment, the mesh 106 may have openings sized to prevent insects from entering into the building on the which the frame assembly 100 is mounted. In some embodiments, the protective frame assembly 100 may be mounted at a distance (e.g., a few inches) in front of a window, a door, a protected surface and/or object(s). The distance is based on a type of application of the protective frame assembly 100. For example, a distance between the protective frame assembly 100 and a window for the protection from a golf ball may be different from a distance between the protective frame assembly 100 and a window for the protection from a baseball. Generally, for protection against golf balls and/or hail, the protective frame assembly 100 may be flush with, or nearly flush with a mounting surface. Further, for larger or heavier objects (e.g., baseballs) the distance is increased by a predetermined value. In some embodiments, the distance may be based on a weight and a velocity of a striking object. In some other embodiments, the distance may be determined using various mathematical algorithms and/or analyses.

In an embodiment, one or more support members may be attached to the protective frame assembly 100 and the mounting surface to maintain a distance between the protective frame assembly 100 and the mounting surface. The support members may be attached to the top side 108, the bottom side 110 and/or the lateral sides 112 of the protective frame assembly 100. In case the protective frame assembly 100 is positioned at a distance from the mounting surface, the protective frame assembly 100 is extended in the top side 108, the bottom side 110 and/or the lateral sides 112. Specifically, the protective frame assembly 100 may be extended in the top side 108, the bottom side 110 and/or the lateral sides 112 by some distance to protect the mounting surface from missiles traveling at an angle with respect to the mounting surface. Moreover, a length of the extension of the frame assembly 100 may depend on a possible angle of strike of a missile.

In an embodiment, the frame assembly 100 may include one or more side panels (not shown in FIGS. 1A and 1B) connected to the outer wall surface of the first frame 102. In another embodiment, the one or more side panels may be connected to the second frame 104. The side panels may prevent a projectile from passing between the mounting surface and the frame assembly 100. In an embodiment, the side panels may be oriented perpendicular to the plane of the mesh 106. In some other embodiments, the side panels may be oriented at an oblique angle relative to the plane of the mesh 106. Each of the side panels may have any suitable shape such as, rectangular, curvilinear and so forth.

In some embodiments, the protective frame assembly 100 may include one or more insect barriers (not shown in FIGS. 1A and 1B) sealed to the first frame 102. In some other embodiments, the insect barrier may also be sealed to the second frame 104. The insect barriers may be attached to the lateral sides 112 of the protective frame assembly 100. In further embodiments, an insect barrier may be disposed over the mesh 106. The insect barrier may be attached to the protective frame assembly 100 by any coupling methods such as, but not limited to, adhesives, mechanical fasteners, welding and so forth. In an embodiment, the insect barrier may be made of a flexible material loosely connected to the frame assembly 100. In another embodiment, the insect barrier may be attached to the frame assembly 100 in a tensioned state similar to the mesh 106. In an exemplary, the insect barrier may exclude insects from entering into the building to which the frame assembly 100 is attached. Additionally, the insect barrier may also stop projectiles.

In some embodiments, the frame assembly 100 may be attached to a fenestration unit by any suitable attachment means to protect the fenestration unit from getting damaged by a missile (e.g., golf balls, baseballs etc.). The attachment means may include, but not limited to, mechanical fasteners, brackets, adhesives or a combination thereof. In alternative embodiments, the frame assembly 100 may be used in a stand-alone application to protect an external structure from striking objects. The external structure may include, but not limited to, windows, walls, statues, fountains and so forth. The frame assembly 100 may be disposed in an upright position near the external structure in order to provide protection. In an embodiment, a stand (not shown) may support the frame assembly 100 in order to retain the frame assembly 100 in the upright position. Further, the stand may keep the frame assembly 100 steady against high impact forces caused by hurricane force winds, and/or striking objects such as, but not limited to, golf balls, baseballs, hail, wind-blown objects (e.g., lightweight lawn furniture) and debris. The stand may include one or more horizontal beams and one or more vertical posts to support the frame assembly 100. In some embodiments, the stand may be fixed to the ground. In an embodiment, the frame assembly 100 may be fixedly attached to the stand by any suitable coupling means such as, but not limited to, mechanical fasteners, welding, adhesives and so forth. In another embodiment, the frame assembly 100 may be detachably attached to the stand. Alternatively, the frame assembly 100 may be fixed to the ground without any stand.

Figure 2:
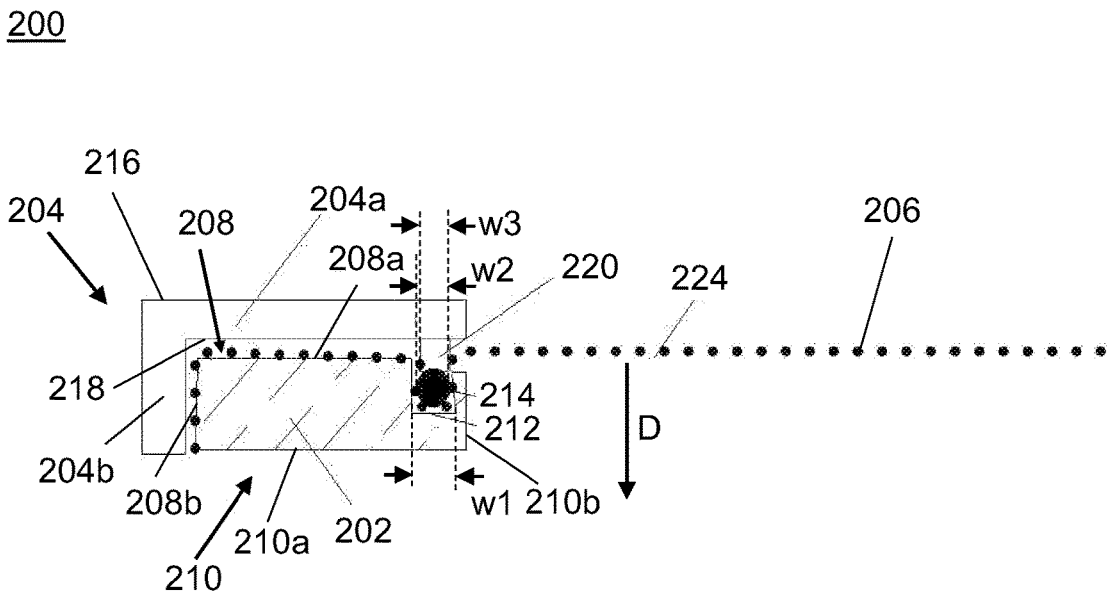
FIG. 2 illustrates a partial sectional view of a protective frame assembly in accordance with the disclosed subject matter.

FIG. 2 illustrates a partial sectional view of a protective frame assembly 200 for an external structure (not shown). In some embodiments, the external structure may include a fenestration unit, a wall, a statue, a fountain and so forth. In an embodiment, the fenestration unit may include a structure for covering an opening of a building. The fenestration unit may include any structure such as, but not limited to, a window, a door, a louvre, vents, a skylight, a storefront, a curtain wall, a slope glazed system, and so forth. The fenestration unit may allow and/or block the passage of light and flow of air through a building. The protective frame assembly 200 (interchangeably referred to as "the frame assembly 200") may be similar to the protective frame assembly 100 (shown in FIGS. 1A and 1B).

FIG. 2 illustrates a sectional view of only one side (e.g., a lateral side or a top side) of the protective frame assembly 200 for illustration purpose. It may be apparent to a person having ordinary skill in the art that the protective frame assembly 200 may have a similar cross-section at an opposite side of the protective frame assembly 200.

The frame assembly 200 includes a first frame 202, a second frame 204 coupled to the first frame 202 and a mesh 206. The first frame 202 may be coupled to the fenestration unit by any suitable methods such as, but not limited to, mechanical fasteners, mechanical joints, welding, adhesives, brazing and so forth. In some embodiments, the first frame 202 may be pivotally coupled to the fenestration unit by one or more hinges (not shown). The hinges may allow the frame assembly 200 to move pivotally and allow easily cleaning of the fenestration unit. In an embodiment, the one or more hinges may be integral with the first frame 202. The first frame 202 includes an inner wall surface 208, and an outer wall surface 210. The inner wall surface 208 includes a first part 208*a* and a second part 208*b* substantially perpendicular to the first part 208*a*. The inner wall surface 208 includes a channel 212 on the first part 208*a*. The channel 212 may have any shape such as, but not limited to, rectangular, circular, polygonal and so forth.

In some embodiments, the channel 212 may receive a spline 214 to retain the mesh 206 within the channel 212. In an exemplary embodiment, the spline 214 is configured to engage with the mesh 206 within the channel 212 to retain the mesh 206 in a tensioned or stressed state. As shown in FIG. 2, the spline 214 retains at least a portion of the mesh 206 within the channel 212 by pressing the portion of the mesh 206 against the inner wall surface 208. In some embodiments, the spline 214 may be biased by one or more springs (not shown) towards the inner wall surface 208 in order to retain the mesh 206 in the tensioned state. The springs may be connected to the first frame 202 or the second frame 204. In an exemplary embodiment, the spline 214 within the channel 212 may prevent crawling of the mesh 206. The spline 214 may have any suitable shape, such as, but not limited to, circular, rectangular, elliptical and so forth. Further, the spline 214 may be made from any suitable material that can be received within the channel, such as including but not limited to rubber or rubber-like materials, and especially those materials that are high temperature and UV exposure rated. The shape, size and material of the spline are exemplary in nature and the spline may any shape, size or material based on requirements. In some embodiments, the spline 214 within the channel 212 may allow a deflection of the mesh 206 toward a plane of a mounting surface. The mounting surface may refer to the fenestration unit or an area surrounding the fenestration unit. The deflection of the mesh 206 may reduce a force of a striking projectile over a calculated distance until a stopping force exceeds the force of the strike. In some embodiments, the tensioning caused by the spline 214 may enable the mesh 206 to return to its pre-strike condition and position, expelling the projectile in the process. In some embodiments, the channel 212 may be located proximal to an edge of the inner wall surface 208. In a further embodiment, the channel 212 may be defined by the first part 208*a* of the inner wall surface 208. In some other embodiments, the channel 212 may be defined by the second part 208*b* of the inner wall surface 208. Alternatively, a position of the channel 212 may depend on a retaining force to be applied on the mesh 206.

In some embodiments, a width "w1" of the channel 212 may be equal to or greater than a width "w2" of the spline 214 to receive the spline 214 within the channel 212. In some embodiments, the width "w1" and the width "w2" may be suitably selected such that the channel 212 and the spline 214 may retain the mesh 206 in the tensioned state with an appropriate force.

In an embodiment, the outer wall surface 210 of the first frame 202 may include a first part 210*a* and a second part 210*b* substantially perpendicular to the first part 210*a*. Further, the first part 208*a* and second part 208*b* of the inner wall surface 208 are opposite to the first part 210*a* and the second part 210*b*, respectively, of the outer wall surface 210. The outer wall surface 210 of the first frame 202 may be mounted on the fenestration unit.

In some embodiments, the first frame 202 may have a solid or a heavily reinforced configuration. In some embodiments, the first frame 202 may be fabricated from any material (e.g., extruded aluminum) with sufficient heavy duty construction to retain the mesh 206 during high impact forces caused by hurricane force winds, and/or missiles such as, but not limited to, golf balls, baseballs, hail, wind-blown objects (e.g., lightweight lawn furniture) and debris. In some other embodiments, the first frame 202 may be made up of a corrosion resistive material which can be used in any environment such as, high moisture environment, salt air environment and so forth.

The second frame 204 includes a front wall surface 216 and a rear wall surface 218 opposite to the front wall surface 216. The second frame 204 may include a first portion 204*a* and a second portion 204*b*. Each of the first and second portions 204*a*, 204*b* includes at least a part of the front wall surface 216 and the rear wall surface 218. The rear wall surface 218 of the second frame 204 faces the inner wall surface 208 of the first frame 202. Specifically, as shown in FIG. 2, the rear wall surface 218 at the first portion 204*a* faces the first part 208*a* of the inner wall surface 208. Further, the rear wall surface 218 at the second portion 204*b* faces the second part 208*b* of the inner wall surface 208. In an exemplary embodiment, the first and second portions 204*a*, 204*b* are substantially perpendicular to each other to define an L-shaped configuration of the second frame 204. In some embodiments, the first and second portions 204*a*, 204*b* may be coupled to each other by any suitable coupling mean such as, but not limited to, adhesives, mechanical fasteners, welding and so forth. In some other embodiments, the second frame 204 may be integrally manufactured. In an embodiment, a thickness of the first portion 204*a* may be substantially equal to a thickness of the second portion 204*b*. In another embodiment, the thickness of the first portion 204*a* may be different from the thickness of the second portion 204*b*.

In an exemplary embodiment, the rear wall surface 218 of the second frame 204 faces the inner wall surface 208 of the first frame 202. In some embodiments, the rear wall surface 218 may completely cover the inner wall surface 208 to prevent the first frame 202 from being damaged by environmental elements. In some other embodiments, the rear wall surface 218 may cover only a portion of the inner wall surface 208 to allow easy installation and removal of the mesh 206.

The rear wall surface 218 further includes a tongue 220 aligned with the channel 212. The tongue 220 may be a protrusion extending from the rear wall surface 218 of the second frame 204. Further, the tongue 220 may located at the first portion 204*a* of the second frame 204. The tongue 220 may engage with the spline 214 to retain the spline 214 within the channel 212. Specifically, the tongue 220 may bias the spline 214 in a direction 'D' towards the inner wall surface 208 of the first frame 202. The tongue 220 may apply an appropriate force on the spline 214 to retain the mesh 206 within the channel 212. In some embodiments, the tongue 220 may have a rectangular shape. In some other embodiments, the tongue 220 may have any suitable shape such as, but not limited to, circular, elliptical, polygonal and so forth. In an exemplary embodiment, the tongue 220 and the spline 214 may prevent crawling of the mesh 206 and keep the mesh 206 in the tensioned state. In some embodiments, the tongue 220 may be integrally formed as a part of the second frame 204. In some other embodiments, the tongue 220 may be coupled to the rear wall surface 218 by any suitable coupling methods, such as, but not limited to, welding, brazing, adhesive and so forth. In some embodiments, the tongue 220 may have a width "w3", which is less than or equal to the width "w1" of the channel 212. The width "w3" may have a suitable value to allow the tongue 220 to retain the spline 214 within the channel 212.

In some embodiments, the second frame 204 may have a solid configuration. The second frame 204 may be fabricated of any material with heavy duty construction to resist high impact forces caused by hurricane force winds, and/or missiles such as, but not limited to, golf balls, baseballs, hail, wind-blown objects (e.g., lightweight lawn furniture) and debris. In some other embodiments, the second frame 204 may be made up of a corrosion resistive material which can be used in any environment such as, high moisture environment, salt air environment and so forth. In some embodiments, the first frame 202 and the second frame 204 may be coupled to each other using one or more mechanical fasteners (not shown in FIG. 2).

In an embodiment, the mesh 206 is sandwiched between the rear wall surface 218 and the inner wall surface 208. In some embodiments, the rear wall surface 218 and the inner wall surface 208 with the mesh 206 therebetween may be coupled to each other via an adhesive. In some other embodiments, the rear wall surface 218 and the inner wall surface 208 may be coupled to each other via one or more mechanical fasteners such as, nails, screws, nut and bolt and so forth. In some embodiments, a height of the first frame 202 may be variable. In an exemplary embodiment, the height of the first frame 202 at an edge adjacent to the channel 212 may be less than the height of the rest of the first frame 202. This may enable a clearance between the inner wall surface 208 of the first frame 202 and the rear wall surface 218 of the second frame 204 in a coupled state. The clearance may facilitate installation and adjustment of the mesh 206 between the first frame 202 and the second frame 204.

In an embodiment, the mesh 206 may be retained in a stressed or tensioned state by the first frame 202 and the second frame 204. In some embodiments, the spline 214 may apply a primary gripping force on the mesh 206 to retain the mesh 206 in the tensioned state. The tongue 220 may engage with the spline 214 so that the spline 214 presses against the mesh 206 within the channel 212 and apply the requisite gripping force. In further embodiments, an additional or secondary gripping force may be supplied by the compression of the mesh 206 between the rear wall surface 218 of the first frame 202 and the inner wall surface 208 of the second frame 204. The primary gripping force applied by the spline 214 and the tongue 220, and the secondary gripping force applied due to compression between the first and second frames 202, 204, may prevent crawling of the mesh 206. The mesh 206 is adapted to absorb an impact energy when a foreign object strikes the mesh 206. Further, the mesh 206 may expel the foreign object upon absorbing the impact energy. In an embodiment, the mesh 206 is resistant to at least one of corrosion, mildew, and a salt air environment. The first frame 202, the spline 214, the mesh 206 and the second frame 204 including the tongue 220 may form a frame sandwich configuration. The frame sandwich configuration (hereinafter referred to as "the sandwich configuration") includes the first frame 202 as one layer and the second frame 204 as another layer, and the mesh 206 retained between the first frame 202 and the second frame 204. The mesh 206 is further engaged by the spline 214 in the sandwich configuration. The sandwich configuration is designed to withstand both the static stresses of the mesh 206 and the dynamic stresses of strike(s) without distortion, dents, or other detectable damage on the mesh 206. The sandwich configuration sets and holds tension on the mesh 206. The sandwich configuration of the first frame 202, the second frame 204 and the mesh 206 may also allow a controlled deflection of the mesh 206 towards a plane of a glass or a protected surface. Further, the sandwich configuration may reduce a force of the striking object over a calculated distance until a stopping force exceeds the force of the strike. Due to the sandwich configuration, the mesh 206 may return to its pre-strike condition and position, expelling the striking object in the process.

In an embodiment, the mesh 206 includes a plurality of openings 224 to allow the passage of light and flow of air. In some embodiments, a size of each opening 224 may depend upon a weight and a velocity of a striking object such as, golf balls, baseballs and so forth. In some embodiments, the mesh 206 may be adapted to absorb an impact energy when a projectile strikes the mesh 206. Further, the mesh 206 may eject the projectile upon absorbing the impact energy. The projectile may include, but not limited to, a golf ball, a baseball, a debris and so forth.

In some embodiments, the mesh 206 is made of a composite material, or a non-metallic material. In some other embodiments, the mesh 206 may include a metallic material coated with a corrosion resistant material such as, but not limited to, polyester film. In an embodiment, the mesh 206 may be made of perforated heavy-duty galvannealed steel or stainless steel. Alternatively, the mesh 206 may be made of any material that provide sufficient strength, air flow, and light passage through the protective frame assembly 200. In some embodiments, the mesh 206 may be made of material that can withstand dynamic stresses of strike(s) without distortion, dents, or other detectable damage.

In an exemplary embodiment, the frame assembly 200 includes a side panel (not shown in FIG. 2) attached to a lateral side of the frame assembly 200. The side panel may partially or fully cover a distance between the frame assembly 200 and a fenestration unit. The side panel may protect the fenestration unit from missiles travelling angularly. In some embodiments, the side panel may be oriented perpendicular to a plane of the frame assembly 200. In some other embodiments, the side panel may be oriented at an oblique angle relative to the plane of the frame assembly. In some embodiments, the side panel may be coupled to the first part 210*a* of the outer wall surface 210 of the first frame 202. In some other embodiments, the side panel may be coupled to the second portion 204*b* of the second frame 204.

Though the frame assembly 200, as illustrated in FIG. 2, includes the tongue 220, the tongue 220 may be optional in certain embodiments of the present disclosure. The tongue 220 may apply additional holding force on the spline 214 for securing large spans of the mesh 206. In some embodiments, the tongue 220 may not be present and the spline 214 alone may retain the mesh 206 within the channel 212 in a tensioned state.

Figure 3:
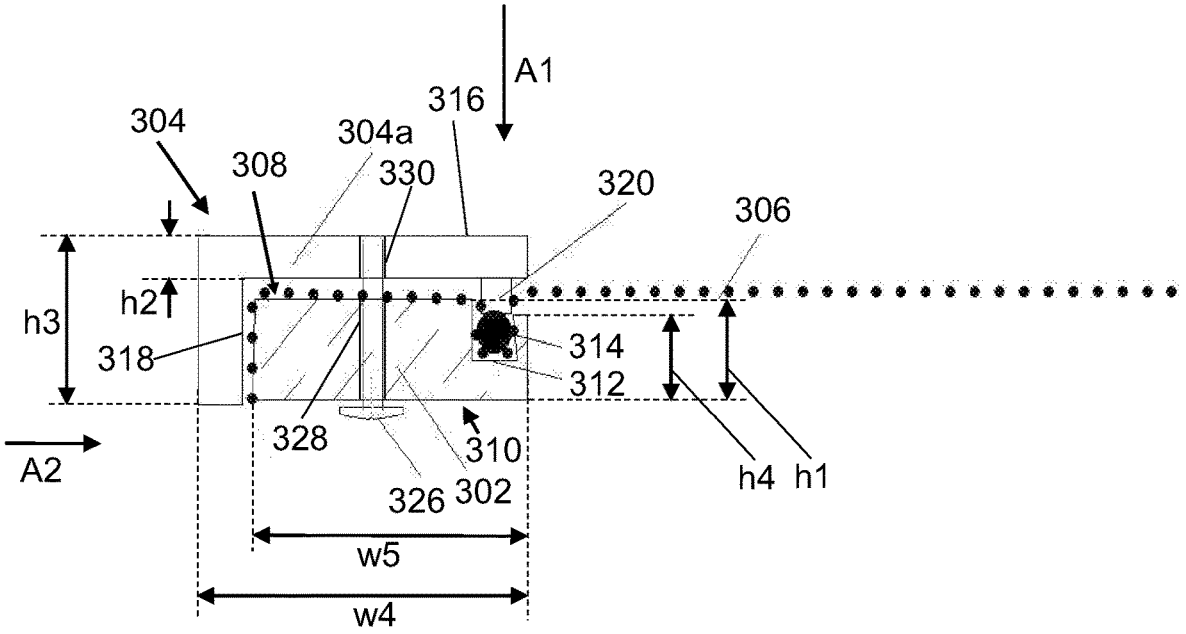
FIG. 3 illustrates a partial sectional view of a protective frame assembly in accordance with the disclosed subject matter.

FIG. 3 illustrates a partial sectional view of a protective frame assembly 300, in accordance with an embodiment of present disclosure. As the protective frame assembly 300 has various parts in common with the protective frame assembly 200 (shown in FIG. 2), description of various parts of the protective frame assembly 300 are omitted in FIG. 3 in order not to obscure the features being described hereinafter.

The protective frame assembly 300 (interchangeably referred to as "the frame assembly 300") includes a first frame 302, a second frame 304 coupled to the first frame 302 and a mesh 306. The first frame 302 includes an inner wall surface 308, and an outer wall surface 310. The inner wall surface 308 includes a channel 312. The channel 312 may have any shape such as, but not limited to, rectangular, circular, polygonal and so forth. The channel 312 is configured to receive a spline 314 therein. The spline 314 is configured to engage with the mesh 306 within the channel 312 to retain the mesh 306 in a tensioned state. Specifically, the spline 314 presses a portion of the mesh 306 within the channel 312 against the inner wall surface 308 in order to hold the mesh 306 in the tensioned state. In an exemplary embodiment, the spline 314 within the channel 312 may prevent crawling of the mesh 306. The spline 314 may have any suitable shape, such as, but not limited to, circular, rectangular, elliptical and so forth. Further, the spline 314 may be made from any suitable material that can be received within the channel, such as including but not limited to rubber or rubber-like materials, and especially those materials that are high temperature and UV exposure rated that can be easily received within the channel 312.

The second frame 304 includes a front wall surface 316 and the rear wall surface 318 opposite to the front wall surface 316. In an exemplary embodiment, the rear wall surface 318 faces the inner wall surface 308 of the first frame 302. In some embodiments, the rear wall surface 318 may completely cover the inner wall surface 308 to prevent the first frame 302 from being damaged by external environment. The rear wall surface 318 includes a tongue 320 aligned with the channel 312. The tongue 320 may engage with the spline 314 to retain the spline 314 within the channel 312. In some embodiments, the tongue 320 may apply an appropriate force on the spline 314 so that the spline 314 presses against the mesh 306. In some embodiments, the tongue 320 may have any suitable shape such as, but not limited to, rectangular, circular, elliptical, polygonal and so forth. In an exemplary embodiment, the tongue 320 and the spline 314 may prevent crawling of the mesh 306 and keep the mesh 306 in the tensioned state.

In some embodiments, the first frame 302 and the second frame 304 may be coupled together by any suitable coupling method. In an exemplary embodiment, one or more fasteners 326 couple the first frame 302 to the second frame 304. The first frame 302 may include a cavity 328 to receive the fastener 326. In an exemplary embodiment, the cavity 328 may extend along a height "h1" of the first frame 302. The second frame 304 may also include a cavity 330 to receive the fastener 326. The cavity 330 is aligned with the cavity 328. In some embodiments, the cavity 330 may extend at least partially along a height "h2" of a first part 304*a* of the second frame 304. In an embodiment, the cavities 328 and 330 are pre-formed before insertion of the fasteners 326. In another embodiment, the cavities 328 and 330 may be formed during insertion of the fastener 326. The fastener 326 may be screws, nails, bolts, and the like. The fastener 326 may extend from the outer wall surface 310 of the first frame 302. Further, the fastener 326 may extend through the first frame 302 and the mesh 306. The fastener 326 may also extend into the second frame 304. Though only one mechanical fastener 326 is illustrated in FIG. 3, the protective frame assembly 300 may utilize multiple such fasteners 326 separated from each other by a predetermined distance. In an embodiment, the predetermined distance may be less than or equal to 18 inches.

In an embodiment, a ratio between a width "w4" of the second frame 304 and a width "w5" of the first frame 302 is greater than one. Therefore, the second frame 304 may cover the first frame 302 from a direction "A1". Further, a ratio between a height "h3" of the second frame 304 and the height "h1" of the first frame 302 is greater than one. Therefore, the second frame 304 may also cover the first frame 302 from a direction "A2". In an exemplary embodiment, the second frame 304 may also completely cover the channel 312 of the first frame 302.

In an exemplary embodiment, a height "h4" of the first frame 302 at an edge adjacent to the channel 312 may be less than the height "h1" of the rest of the first frame 302. This may enable a clearance between the inner wall surface 308 of the first frame 302 and the rear wall surface 318 of the second frame 304 in a coupled state. The clearance may facilitate installation and adjustment of the mesh 306 between the first frame 302 and the second frame 304.

Figure 4:
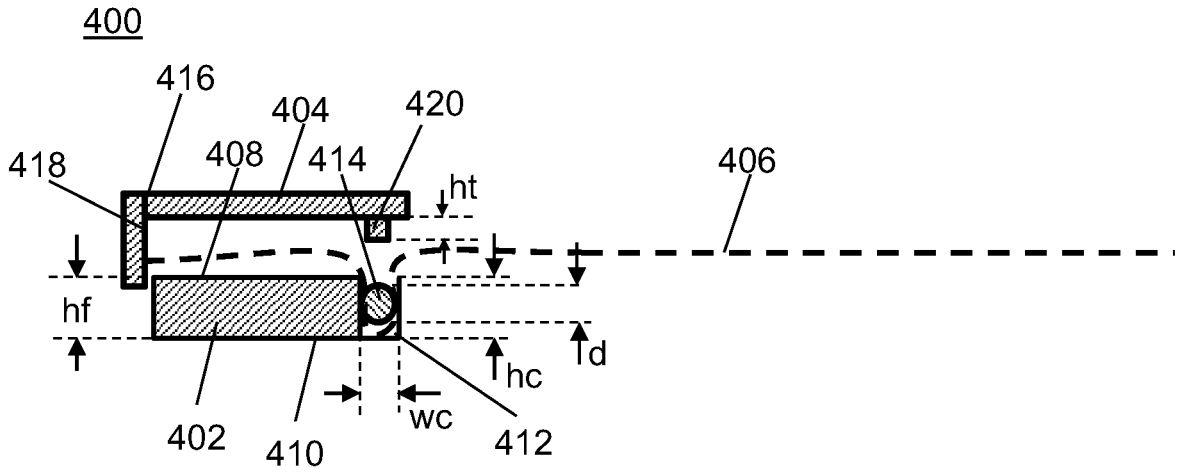
FIG. 4 illustrates a disassembled view of a protective frame assembly in accordance with the disclosed subject matter.

FIG. 4 illustrates a disassembled view of a protective frame assembly 400, in accordance with an embodiment of present disclosure. The protective frame assembly 400 may be similar to the protective frame assembly 200. The protective frame assembly 400 (interchangeably referred to as "the frame assembly 400") includes a first frame 402, a second frame 404, and a mesh 406. The first frame 402 may be similar to the first frame 202 of the protective frame assembly 200 (shown in FIG. 2). The first frame 402 includes an inner wall surface 408 and an outer wall surface 410 opposite to the inner wall surface 408. The inner wall surface 408 includes a channel 412. In the illustrated embodiment, the channel 412 a height "hc" and a width "wc". In some embodiments, the height "hc" may be equal to or less than a height "hf" of the first frame 402. In an exemplary embodiment, the channel 412 may have a rectangular shape. In some embodiments, the channel 412 may have any suitable shape such as, circular, elliptical and so forth.

In some embodiments, the mesh 406 may be placed over the inner wall surface 408 of the first frame 402. In further embodiments, the mesh 406 may be temporarily held tightly by any holding device, while inserting a spline 414 within the channel 412. The holding device may include devices such as, but not limited to, a clamp. In some embodiments, the spline 414 may press the mesh 406 against the inner wall surface 408 to hold the mesh 406 in an appropriate stressed state required for the operation of the protective frame assembly 400. In an exemplary embodiment, the spline 414 may have a circular shape with a diameter "d". In some embodiments, the diameter "d" may be less than or equal to the width "wc" of the channel 412 to allow easy insertion of the spline 414 within the channel 412. In some embodiments, the mesh 406 may also be coupled to the inner wall surface 408 by any coupling methods such as, but not limited to, adhesives, fasteners and so forth.

The second frame 404 is configured to be coupled with the first frame 402. The second frame 404 includes a front wall surface 416 and a rear wall surface 418. The second frame 404 may be coupled to the first frame 402 such that the rear wall surface 418 faces the inner wall surface 408 of the first frame 402. In some embodiments, the second frame 404 may be placed over the first frame 402, after the mesh 406 is retained within the channel 412 by the spline 414. Further, multiple fasteners or any other suitable coupling methods may be used to couple the second frame 404 to the first frame 402. In an exemplary embodiment, the second frame 404 includes a tongue 420. The tongue 420 is configured to engage with the spline 414 to retain the spline 414 within the channel 412. In some embodiments, the tongue 420 may be integrally formed with the second frame 404. In some other embodiments, the tongue 420 may be coupled to the rear wall surface 418 of the second frame 404 by any suitable coupling methods, such as, but not limited to, welding, brazing, adhesives and so forth. In the illustrated embodiment, the tongue 420 has a height "ht". In some embodiments, the sum of the height "ht" of the tongue 420 and the diameter "d" of the spline 414 is greater than or equal to the height "hc" of the channel 412, so that the mesh 406 can be securely retained between the first frame 402 and the second frame 404 by the spline 414 and the tongue 420.

Figure 5:
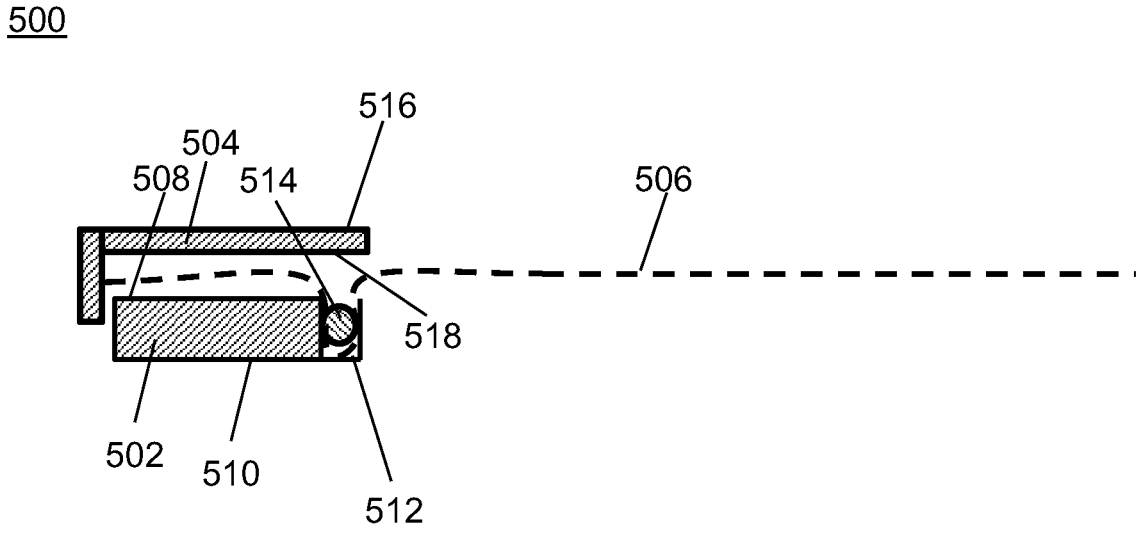
FIG. 5 illustrates a disassembled view of a protective frame assembly in accordance with the disclosed subject matter.

FIG. 5 illustrates a disassembled view of a protective frame assembly 500 (interchangeably referred to as "the frame assembly 500"), in accordance with an embodiment of present disclosure. As the protective frame assembly 500 has various parts in common with the protective frame assembly 400 (shown in FIG. 4), description of various parts of the protective frame assembly 500 are omitted in FIG. 5 in order not to obscure the features being described hereinafter.

The frame assembly 500 includes a first frame 502, a second frame 504, and a mesh 506. The first frame 502 includes an inner wall surface 508 and an outer wall surface 510 opposite to the inner wall surface 508. The inner wall surface 508 includes a channel 512. In an exemplary embodiment, the channel 512 may have a rectangular shape. In some other embodiments, the channel 512 may have any suitable shape such as, circular, elliptical and so forth.

The second frame 504 is configured to be coupled with the first frame 502. The second frame 504 includes a front wall surface 516 and a rear wall surface 518 opposite to the front wall surface 516. The second frame 504 may be coupled to the first frame 502 such that the rear wall surface 518 faces the inner wall surface 508 of the first frame 502. In some embodiments, the second frame 504 may be placed over the first frame 502, after the mesh 506 is retained within the channel 512 by the spline 514. The spline 514 engages with the mesh 506 within the channel 512 to retain the mesh 506 in a tensioned state. In an exemplary embodiment, the rear wall surface 518 may have a planar shape. The rear wall surface 518 may abut the inner wall surface 508 to retain the mesh 506 therebetween. In some other embodiments, the rear wall surface 518 may include a spring (not shown) aligned with the channel 512. The spring engages with the spline 514 to retain the spline 514 within the channel 512. The spring and the spline 514 may retain the mesh 506 between the first frame 502 and the second frame 504 in a tensioned state. In some other embodiments, the inner wall surface 508 may include a spring (not shown) within the channel 512 to bias the spline 514 towards the rear wall surface 518, thereby retaining the mesh 506 within the channel 512. Further, multiple fasteners or any other suitable coupling methods may be used to couple the second frame 504 to the first frame 502.

Figure 6:
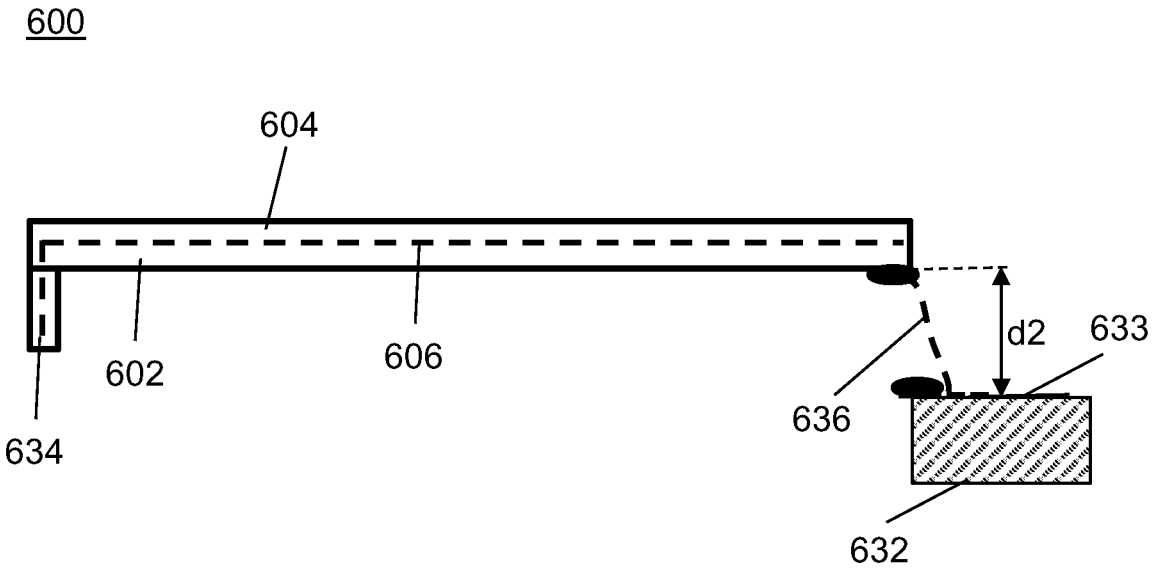
FIG. 6 is a top view of a protective frame assembly in accordance with the disclosed subject matter.

FIG. 6 illustrates a top view of a protective frame assembly 600, in accordance with an embodiment of the present disclosure. The protective frame assembly 600 may be similar to the protective frame assembly 400 (shown in FIG. 4). Therefore, description of various parts of the protective frame assembly 600 are omitted in FIG. 6 in order not to obscure the features being described hereinafter.

The protective frame assembly 600 (interchangeably referred to as "the frame assembly 600") includes a first frame 602, a second frame 604 coupled to the first frame 602, and a mesh 606 sandwiched between the first frame 602 and the second frame 604. The protective frame assembly 600 may be coupled to an external structure 632. The external structure 632 may include any structure such as, but not limited to, a frame of a fenestration unit, a wall and so forth. In an embodiment, the first frame 602 may be coupled to the external structure 632. In another embodiment, the second frame 604 may be coupled to the external structure 632. The protective frame assembly 600 may be coupled to a surface of the external surface 632 via any coupling methods such as, but not limited to, adhesives, mechanical fasteners, hinges, and so forth. In an exemplary embodiment, the protective frame assembly 600 is secured a distance "d2" from a surface 633 of the external structure 632. In alternative embodiments, the protective frame assembly 600 may be flush with the surface 633 of the external structure 632.

In an exemplary embodiment, the frame assembly 600 includes a side panel 634 attached to a lateral side of the frame assembly 600. The side panel 634 may partially or fully cover the distance "d2" between the surface 633 and the frame assembly 600. The side panel 634 may protect the external surface 632 from missiles travelling angularly. In some embodiments, the side panel 634 may be oriented perpendicular to a plane of the frame assembly 600. In some other embodiments, the side panel 634 may be oriented at an oblique angle relative to the plane of the frame assembly 600. The side panel 634 may have any suitable shape such as, rectangular, curvilinear and so forth. In some embodiments, the frame assembly 600 may include one or more side panels at each side of the frame assembly 600. Further, the side panel 634 may be coupled to the frame assembly 600 at one end and free at another end. In some other embodiments, the side panel 634 may be coupled to both the surface 633 and the frame assembly 600. In an embodiment, the side panel 634 may be connected to the first frame 602. In another embodiment, the side panel 634 may be connected to the second frame 604.

In an exemplary embodiment, the frame assembly 600 also includes an insect barrier 636 attached at a lateral side of the frame assembly 600. The insect barrier 636 may also be connected to multiple sides of the frame assembly 600. The insect barrier 636 may cover the distance "d2" between the external surface 632 and the frame assembly 600. In an embodiment, the insect barrier 636 may be sealably coupled to the protective frame assembly 600. In some other embodiments, the insect barrier 636 may be sealably coupled to each of the surface 633 and the frame assembly 600. The insect barrier 636 may be attached to the protective frame assembly 600 by any coupling methods such as, but not limited to, adhesives, mechanical fasteners, welding and so forth. The sealing between the insect barrier 636 and the frame assembly 600 may be provided by a suitable sealant, for example, a silicone based sealant. In an embodiment, the insect barrier 636 may be made of a flexible material loosely connected with the frame assembly 600. In another embodiment, the insect barrier 636 may be attached to the frame assembly 600 in a tensioned state similar to the mesh 606. In an exemplary, the insect barrier 636 may exclude insects from entering through the external structure 632. Additionally, the insect barrier 636 may stop projectiles.

In an embodiment, one or more support members (not shown) may couple the protective frame assembly 600 to the external structure 632. The support members may maintain the distance "d2" between the protective frame assembly 600 and the surface 633. The support members may be coupled to the first frame 602 and/or the second frame 604. Further, the support members may be coupled to the protective frame assembly 600 and the external surface 632 by any suitable attachment methods, such as, adhesives, fasteners, welding, and so forth.

II. Method of Assembly

Figure 7:
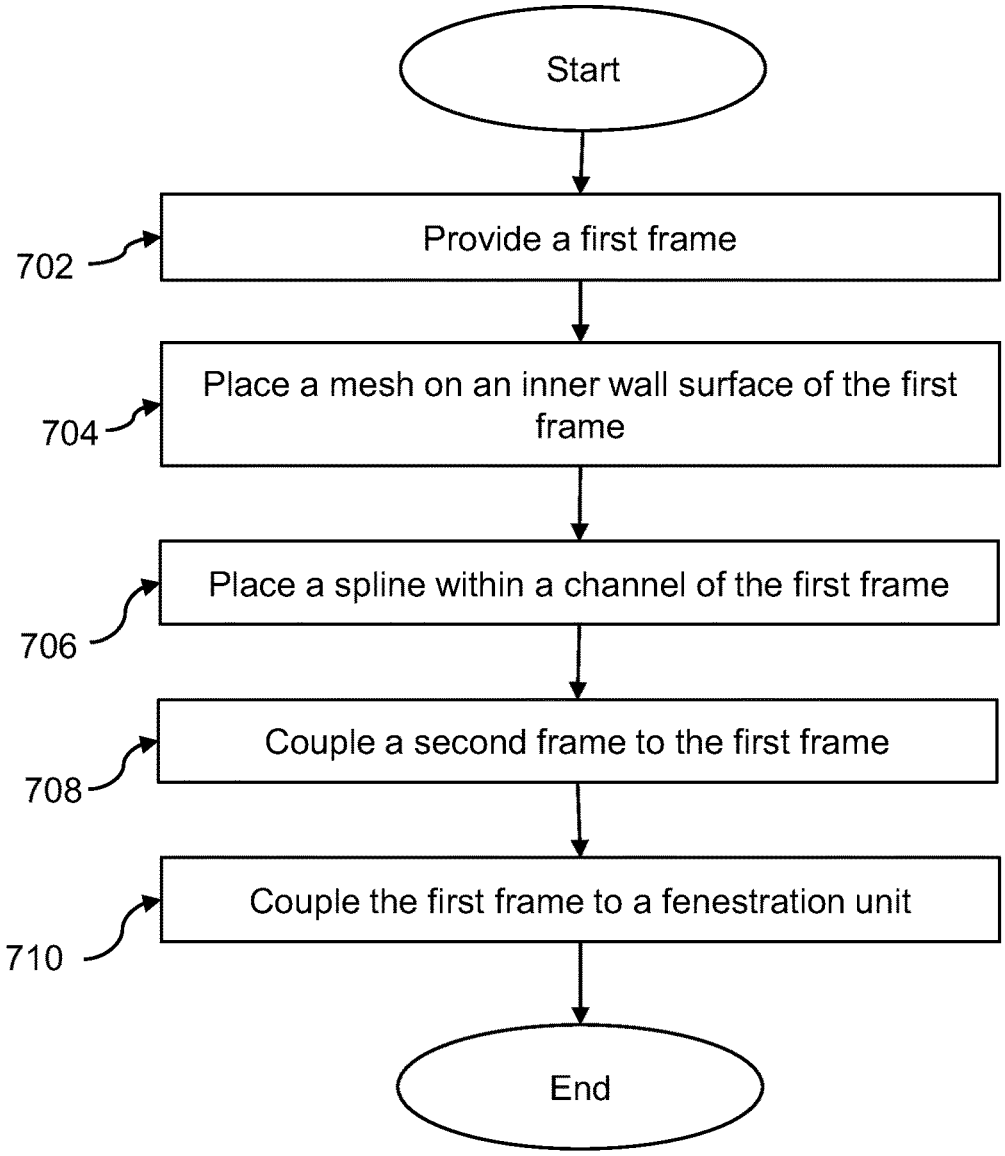
FIG. 7 is a flowchart of a method of assembling a protective frame assembly in accordance with the disclosed subject matter.

FIG. 7 is a flowchart of an exemplary method 700 of assembling a protective frame assembly in accordance with an embodiment of the disclosed subject matter. This flowchart is merely provided for exemplary purposes, and embodiments are intended to include or otherwise cover any methods or procedures for assembling the protective frame assembly. The method 700 of assembling is in accordance with the above described embodiments, therefore corresponding reference numbers have been used to describe the method 700. For illustrative purpose, the method 700 may be described with reference to various parts of the protective frame assembly 500 (shown in FIG. 5).

At step 702, the method 700 includes providing the first frame 502. The first frame 502 includes the inner wall surface 508 and the outer wall surface 510 opposite to the inner wall surface 508. Next at step 704, the method 700 includes placing the mesh 506 on the inner wall surface 508 of the first frame 502. The mesh 506 may be made up of a flexible material having sufficient strength and rigidity required for the application. The mesh 506 may be attached to the inner wall surface 508 of the first frame 502 by any suitable coupling methods, such as, mechanical fasteners, adhesives, and so forth. In an embodiment, the mesh 506 may be temporarily held by a holding device, for example, one or more clamps.

At step 706, the method 700 include placing the spline 514 within the channel 512 so that the mesh 506 passes between the spline 514 and the inner wall surface 508 within the channel 512. The spline 514 is configured to engage with the mesh 506 within the channel 512 to retain the mesh 506 in a tensioned state. In an exemplary embodiment, the spline 514 is placed within the channel 512 to prevent crawling of the mesh 506. The spline 514 may have any suitable shape, such as, but not limited to, circular, rectangular, elliptical and so forth. Further, the spline 514 may be made from any suitable material that can be received within the channel, such as including but not limited to rubber or rubber-like materials, and especially those materials that are high temperature and UV exposure rated that can be easily received within the channel 512. In an exemplary embodiment, the spline 514 may be forcibly pushed within the channel 512 to tightly secure the spline 514 within the channel 512.

Next at step 708, the method 700 includes coupling the second frame 504 to the first frame 502 so that the mesh 506 is sandwiched between the first frame 502 and the second frame 504. The second frame 504 includes the front wall surface 516 and the rear wall surface 518. In an embodiment, the rear wall surface 518 may have a planar shape. In some embodiments, the rear wall surface 518 may abut the inner wall surface 508 in the coupled state. In alternative embodiments, the second frame 504 may include the tongue 420 (as shown in FIG. 4) aligned with the channel 512 of the first frame 502. The tongue 420 may engage with the spline 514 to retain the mesh 506 in a tensioned state. The tongue 420 may apply additional holding force on the spline 514 for securing large spans of the mesh 506. In an exemplary embodiment, the first frame 502 may be coupled to the second frame 504 via one or more fasteners 326 (shown in FIG. 3). Alternatively, the first frame 502 may be coupled to the second frame 504 via any other coupling methods such as, but not limited to, welding, brazing, adhesive and so forth. After coupling the second frame 504 to the first frame 502, any holding device that temporarily holds the mesh 506 may be removed.

Next at step 710, the method 700 includes coupling the first frame 502 to the fenestration unit. In some other embodiments, the second frame 504 may be coupled to the fenestration unit. In some embodiments, the first frame 502 may be pivotally coupled to the fenestration unit via one or more hinges. The first frame 502 may be coupled to the fenestration by any suitable methods such as, but not limited to, adhesives, mechanical fasteners, welding and so forth. In another embodiment, the first frame 502 may be coupled to the fenestration unit by one or more support members (not shown). The support members may retain the protective frame assembly 500 at a distance from the fenestration unit. The support members may be coupled to the first frame 502 and/or the second frame 504.

In alternative embodiments, the frame assembly 500 may be used in a stand-alone application to protect an external structure from striking objects. The external structure may include, but not limited to, windows, walls, statues, fountains and so forth. The frame assembly 500 may be disposed in an upright position near the external structure in order to provide protection. In an embodiment, a stand (not shown) may support the frame assembly 500 in order to retain the frame assembly 500 in the upright position. Further, the stand may keep the frame assembly 500 steady against high impact forces caused by hurricane force winds, and/or striking objects such as, but not limited to, golf balls, baseballs, hail, wind-blown objects (e.g., lightweight lawn furniture) and debris. The stand may include one or more horizontal beams and one or more vertical posts to support the frame assembly 500. In some embodiments, the stand may be fixed to the ground. In an embodiment, the frame assembly 500 may be fixedly attached to the stand by any suitable coupling means such as, but not limited to, mechanical fasteners, welding, adhesives and so forth. In another embodiment, the frame assembly 500 may be detachably attached to the stand. Alternatively, the frame assembly 500 may be directly fixed to the ground without any stand.

According to the method 700, as described above, the first frame 502 is coupled to the fenestration unit after assembling the protective frame assembly 500. However, in alternative embodiments, the first frame 502 may be first coupled to the fenestration unit. Thereafter, the mesh 506, the spline 514 and the second frame 504 may be assembled with the first frame 502.

In some embodiments, one or more side panels and/or insect barriers may also be coupled to the protective frame assembly 500 during or after assembly.

Though the method 700 have been described with reference to the protective frame assembly 500, the method 700 may also be used for the protective frame assemblies 100, 200, 300, 400 and 600.

III. Other Exemplary Embodiments

Embodiments of the present disclosure cover a protective frame assembly for protecting an article, for example, but not limited to, a window, a door, a glass surface, and so forth. The protective frame assembly protects the article against strikes from a striking object.

Embodiments of the present disclosure also cover a protective frame assembly that is assembled prior to installation on the article to be protected. Embodiments of the present disclosure are further intended to include a protective frame assembly that is assembled on site.

Embodiments of the present disclosure are also intended to include a protective frame assembly that can be mounted on a structure in an outdoor environment, for example, a park, a golf course, a garden and so forth. A protective frame assembly can also be coupled to an adjacent protective frame assembly to form a protective barrier of desired length and shape.

While certain embodiments of the invention are described above, and FIGS. 1A to 7 disclose the best mode for practicing the various inventive aspects, it should be understood that the invention can be embodied and configured in many different ways without departing from the spirit and scope of the invention.

While the subject matter has been described in detail with reference to exemplary embodiments thereof, it will be apparent to one skilled in the art that various changes can be made, and equivalents employed, without departing from the scope of the invention. All related art references discussed in the above Background section are hereby incorporated by reference in their entirety.

What is claimed is:

1. A protective frame assembly comprising:

a first frame including an inner wall surface and an outer wall surface opposite to the inner wall surface, wherein the inner wall surface includes a channel formed in a front side thereof;

a second frame coupled to the first frame, the second frame including a front wall surface and a rear wall surface opposite to the front wall surface, wherein the rear wall surface of the second frame faces the inner wall surface of the first frame, and a front side of the rear wall surface opposes the front side of the inner wall surface, and the second frame covers the first frame from each of a direction parallel to the channel and a direction perpendicular to the channel;

a spline received within the channel of the first frame;

a mesh sandwiched between the first frame and second frame such that the mesh is retained in a tensioned state by the first frame and the second frame and extends substantially flat along an entire length of the inner wall surface of the front side of the first frame on both sides of the channel, wherein the entire length of the inner wall surface of the front side of the first frame extends in a direction perpendicular to the channel from a first edge of the first frame to an opposite second edge of the first frame, and the spline engages with the mesh within the channel to further retain the mesh in a further tensioned state; and a tongue protruding from the rear wall surface of the second frame and aligned opposite the channel of the first frame, wherein the tongue is configured to engage directly with the spline to retain the spline within the channel.

2. The protective frame assembly of claim 1, wherein the mesh is further adapted to allow light and air to pass therethrough.

3. The protective frame assembly of claim 1, further comprising one or more fasteners to couple the first frame to the second frame.

4. The protective frame assembly of claim 1, wherein the mesh is resistant to at least one of corrosion, mildew, and a salt air environment.

5. The protective frame assembly of claim 1, further comprising one or more insect barriers sealably coupled to the first frame or the second frame.

6. The protective frame assembly of claim 1, further comprising one or more side panels connected to the second frame.

7. The protective frame assembly of claim 1, further comprising one or more hinges configured to pivotally attach the protective frame assembly to an external structure.

8. The protective frame assembly of claim 1, wherein the outer wall surface of the first frame is mounted on a fenestration unit.

9. The protective frame assembly of claim 8, wherein the first frame further comprises one or more hinges extending from the outer wall, wherein the one or more hinges pivotally couple the first frame to the fenestration unit.

10. The protective frame assembly of claim 1, wherein the first and second frames are configured to be separated to permit repair or replacement of components, including the mesh.

11. The protective frame assembly of claim 10, wherein the mesh is further adapted to absorb an impact energy when a foreign object strikes the mesh.

12. The protective frame assembly of claim 10, further comprising one or more fasteners to couple the first frame with the second frame.

13. The protective frame assembly of claim 10, further comprising one or more insect barriers sealably coupled to the first frame or the second frame.

14. The protective frame assembly of claim 10, further comprising one or more side panels connected to the first frame or the second frame.

15. A protective frame assembly for an external structure, the protective frame assembly comprising:

a first frame coupled to the external structure, the first frame including an inner wall surface and an outer wall surface opposite to the inner wall surface, wherein the inner wall surface includes a channel formed in a front side thereof;

a second frame coupled to the first frame, the second frame including a front wall surface and a rear wall surface opposite to the front wall surface, wherein the rear wall surface of the second frame faces the inner wall surface of the first frame, and a front side of the rear wall surface opposes the front side of the inner wall surface, and the second frame covers the first frame from each of a direction parallel to the channel and a direction perpendicular to the channel;

a spline received within the channel of the first frame;

a mesh sandwiched between the first frame and second frame such that the mesh is retained in a tensioned state by the first frame and the second frame and extends substantially flat along an entire length of the inner wall surface of the front side of the first frame on both sides of the channel, wherein the entire length of the inner wall surface of the front side of the first frame extends in a direction perpendicular to the channel from a first edge of the first frame to an opposite second edge of the first frame, and the spline engages with the mesh within the channel to further retain the mesh in a further tensioned state; and a tongue protruding from the rear wall surface of the second frame and aligned opposite the channel of the first frame, wherein the tongue is configured to engage directly with the spline to retain the spline within the channel.

16. A method of assembling a protective frame assembly, the method comprising:

providing a first frame including an inner wall surface and an outer wall surface opposite to the inner wall surface, wherein the inner wall surface includes a channel formed in a front side thereof;

placing a mesh on the inner wall surface of the first frame;

placing a spline within the channel of the first frame so that the mesh passes between the spline and the inner wall surface of the first frame, wherein the spline engages with the mesh within the channel to retain the mesh in a tensioned state; and coupling a second frame to the first frame such that the second frame covers the first frame from each of a direction parallel to the channel and a direction perpendicular to the channel so that the mesh is retained in a tensioned state by the first frame and the second frame and is sandwiched between and extending flat along an entire length of the inner wall surface of the front side of the first frame on both sides of the channel, wherein the entire length of the inner wall surface of the front side of the first frame extends in a direction perpendicular to the channel from a first edge of the first frame to an opposite second edge of the first frame, and the spline engages with the mesh within the channel to further retain the mesh in a further tensioned state; and providing a tongue protruding from the rear wall surface of the second frame and aligned opposite the channel of the first frame, the tongue engaging directly with the spline to retain the spline within the channel.

17. The method of claim 16, wherein the second frame is coupled to the first frame via one or more fasteners.

18. The method of claim 16, further comprising coupling the first frame to an external structure.

* * * * *